US007770422B1

(12) United States Patent
Sierra

(10) Patent No.: US 7,770,422 B1
(45) Date of Patent: Aug. 10, 2010

(54) ROUND PADLOCK

(76) Inventor: Rafael Sierra, 865 E. 7th St., Long Beach, CA (US) 90813

( * ) Notice: Subject to any disclaimer, the term of this patent is extended or adjusted under 35 U.S.C. 154(b) by 0 days.

(21) Appl. No.: 12/264,114

(22) Filed: Nov. 3, 2008

(51) Int. Cl.
*E05B 67/36* (2006.01)

(52) U.S. Cl. ..... 70/32; 70/2; 70/6

(58) Field of Classification Search ..... 70/2, 70/6–13, 32–34, 54–56, 416, 417
See application file for complete search history.

(56) References Cited

U.S. PATENT DOCUMENTS

| | | | | | |
|---|---|---|---|---|---|
| 648,226 | A * | 4/1900 | Atkinson | 70/32 |
| 834,591 | A * | 10/1906 | Streams | 70/6 |
| 1,546,021 | A * | 7/1925 | Parmele | 70/32 |
| 1,575,092 | A | 3/1926 | Best | |
| 1,764,367 | A * | 6/1930 | Szymanski | 70/8 |
| 1,783,905 | A * | 12/1930 | Copell | 70/32 |
| 1,814,646 | A * | 7/1931 | Terrill | 70/6 |
| 1,866,955 | A * | 7/1932 | Terrill | 70/6 |
| 2,193,368 | A * | 3/1940 | Harrison | 70/32 |
| 2,492,318 | A * | 12/1949 | Reichert | 70/32 |
| 2,660,872 | A * | 12/1953 | Beach | 70/32 |
| 3,736,780 | A | 6/1973 | Singer | |
| 3,820,360 | A * | 6/1974 | Best | 70/6 |
| 3,901,058 | A * | 8/1975 | Best | 70/32 |
| 3,996,774 | A * | 12/1976 | Best | 70/32 |
| 4,068,509 | A | 1/1978 | Genakis | |
| 4,754,626 | A | 7/1988 | Siegel | |
| 5,669,255 | A | 9/1997 | Albano | |
| 5,979,200 | A | 11/1999 | Cliff | |
| 6,155,090 | A | 12/2000 | Rubensson | |
| 6,675,614 | B2 | 1/2004 | Lai | |
| 6,766,671 | B2 * | 7/2004 | Haczynski et al. | 70/23 |
| 6,854,303 | B2 | 2/2005 | Shiao et al. | |
| 2003/0188558 | A1 | 10/2003 | Shiao et al. | |
| 2006/0096344 | A1 | 5/2006 | Lee | |
| 2006/0260368 | A1 * | 11/2006 | Reitchuk | 70/33 |

* cited by examiner

*Primary Examiner*—Suzanne D Barrett
(74) *Attorney, Agent, or Firm*—QuickPatents, Inc.; Kevin Prince

(57) ABSTRACT

A lock for engaging a U-shaped staple is disclosed. The lock includes a cylindrical cover that has a front face open at a key hole aperture, a continuous annular side wall, and a rear side that is open at least at a staple slot. A lock cylinder assembly is housed within the interior space of the cylindrical cover and has a key slot in a front face thereof. A barrel is rotatably captured within a cylinder, such that the barrel is only rotatable within the cylinder when a properly-shaped key is inserted into the key slot. The barrel includes a cam follower that rotates between a locked position and an unlocked position. A bolt assembly is fixed at a proximal end to the cam follower and adapted so that a bolt thereof at least partially traverses the staple slot when the cam follower is moved from the unlocked position to the locked position.

3 Claims, 6 Drawing Sheets

ROUND PADLOCK

CROSS-REFERENCE TO RELATED APPLICATIONS

Not Applicable.

STATEMENT REGARDING FEDERALLY SPONSORED RESEARCH AND DEVELOPMENT

Not Applicable.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

FIELD OF THE INVENTION

This invention relates to locks, and more particularly to a round padlock.

DISCUSSION OF RELATED ART

The use of coin-operated vending machines has become common, but one major problem with such machines is that they are prime theft and vandalism targets. Several prior art lock systems used to secure such vending machines include an external hasp and staple, as is commonly used with gates or other closures, or an internal lock. Such devices can be forced by pry bars or bolt cutters relatively easily, however.

Round-shaped shackles padlocks are also known, which have the goal of reducing the ability to force such locks with pry bars, cutting tools, and the like. However, such locks still typically have their key hole in the side of a cylindrical wall thereof. For example, U.S. Pat. No. 6,338,261 to Liu on Jan. 15, 2002, teaches such a device. Having a key hole on the side of such a lock increases its chance of being forced, since any protrusion or aperture in the side of such a lock may be used as a pry point for a prying implement.

One prior art patent, U.S. Pat. No. 3,820,360 issued to Best on Jun. 28, 1974, teaches a relatively complicated round padlock having a key hole in a front face thereof. Such a device is costly to produce due to the number of cast parts having complicated channels and interlocking, pivoting members. Further, such a device is not well suited for engaging existing hasp and staple-type lock devices. As such, to use such a device, it may be necessary to remove the existing hasp and staple-type lock device from the closure to which they are attached. This complicates and increases the cost of installation of such a device.

Therefore, there is a need for a lock that has a continuous cylindrical side wall that provides no anchor points for cutting tools, pry bars, or the like. Such a round continuous side wall is large enough to be difficult to grasp with vice grips or similar implements. Such a needed device would further be adaptable to a variety of lock staples, hasps, and the like, and would be made from a minimal number of internal parts each of which are relatively easy to produce to reduce cost. The present invention accomplishes these objectives.

SUMMARY OF THE INVENTION

The present device is a lock for engaging a U-shaped staple. The lock includes a cylindrical cover that has a front face open at a key hole aperture, a continuous annular side wall, and a rear side that is open at least at a staple slot. No protrusions or apertures are included on the annular side wall, which could serve as a point to attack the lock with a pry bar or the like.

A lock cylinder assembly is housed within the interior space of the cylindrical cover and has a key slot in a front face thereof. A barrel is rotatably captured within a cylinder, such that the barrel is only rotatable within the cylinder when a properly-shaped key is inserted into the key slot. The barrel includes a cam follower that rotates between a locked position and an unlocked position.

A bolt assembly is fixed at a proximal end to the cam follower and adapted so that a bolt thereof at least partially traverses the staple slot when the cam follower is moved from the unlocked position to the locked position. As such, in use, with the lock engaged over the staple and a hasp, the key is inserted into the key slot and the barrel is turned such that the bolt traverses the staple slot to fix the staple thereto.

The present invention is a lock that has a continuous cylindrical side wall that provides no anchor points for cutting tools, pry bars, or the like. Such a round continuous side is wall is large enough to be difficult to grasp with vice grips or similar implements. Such a needed device is adaptable to a variety of lock staples, hasps, and the like. Such a needed invention would further be made from a minimal number of internal parts each of which are relatively easy to produce in order to minimize cost. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of a round lock are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
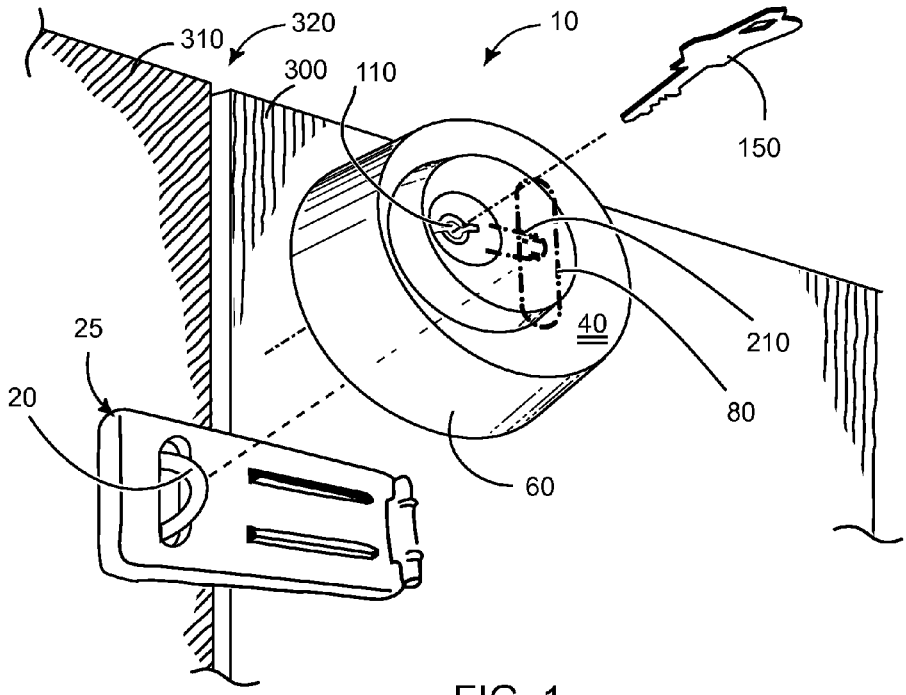
FIG. 1 is a perspective exploded view of a common hasp being secured with a first preferred embodiment of a front-keyed padlock of the invention.
Figure 2:
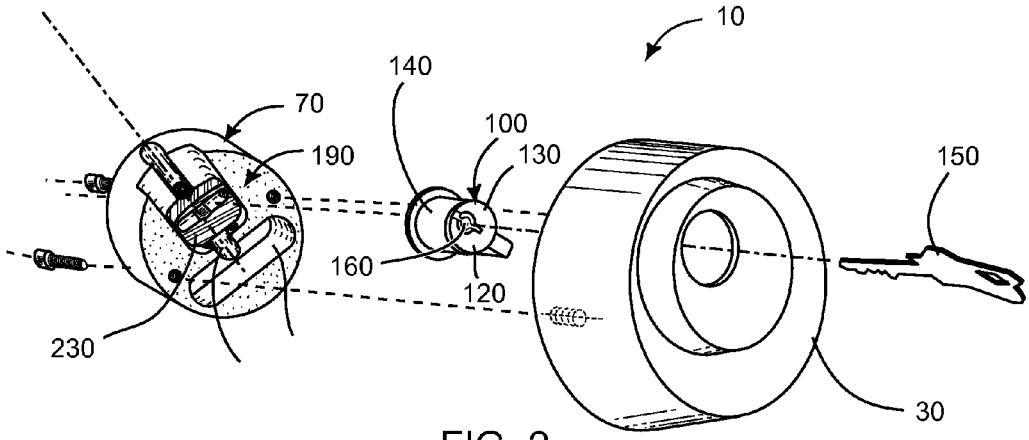
FIG. 2 is an exploded view of the first preferred embodiment of the invention.

FIGS. 1 and 2 illustrate a lock 10 for engaging a U-shaped staple 20. Such a staple 20 may be a U-shaped ring (FIG. 1), or the like, which traverses a slot in a hasp 25, for example. Such a staple 20 and hasp 25 are commonly used on gates, and the like, with a standard padlock.

The present lock 10 includes a cylindrical cover 30 that has a front face 40 open at a key hole aperture 50, a continuous annular side wall 60, and a rear side 70 that is open at least at a staple slot 80. The cylindrical cover 30 defines an interior space 90 therein. No protrusions or apertures are included on the annular side wall 60, which could serve as a point to attack the lock with a pry bar or the like. The lock components 10 are preferably all rigid metal, formed by casting or the like.

Figure 3:
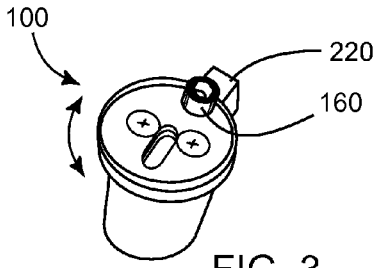
FIG. 3 is a perspective view of a cylinder illustrating a cam-follower and a cylinder foot of the invention.
Figure 6:
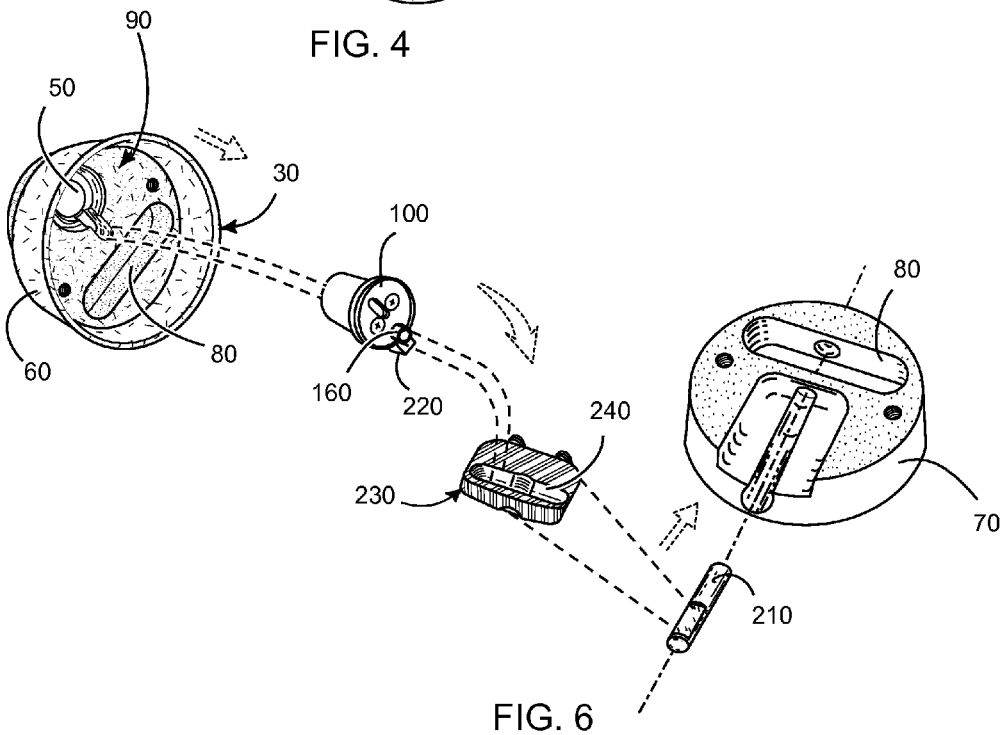
FIG. 6 is an exploded view illustrating assembly of the cover onto the cylinder, and then onto the slider, and then onto the bolt and into the slider block of the invention.
Figure 7:
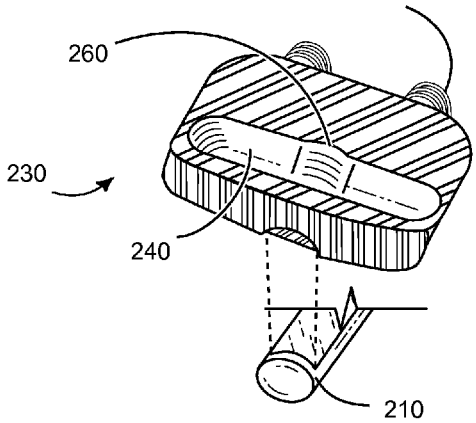
FIG. 7 is a perspective view of the slider block illustrating a locked-position cam detent, and further illustrating alignment of the slider block to the bolt of the invention.
Figure 8:
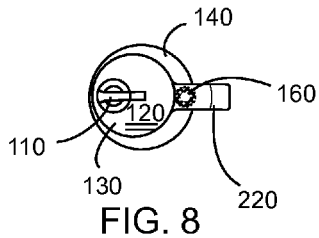
FIG. 8 is an elevation view of the cylinder, illustrating the relative location of the cam follower thereto.
Figure 9:
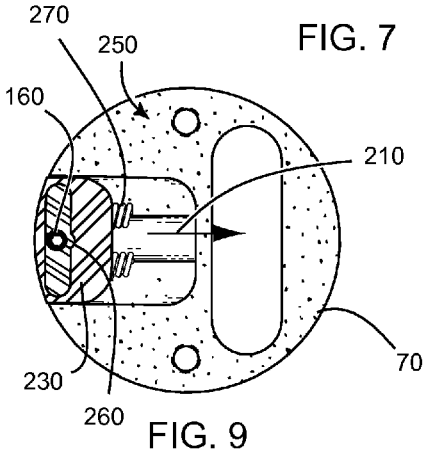
FIG. 9 is an elevation view of the slider block and bolt in an unlocked position, and further illustrating a cam follower location for the unlocked position.

A lock cylinder assembly 100 (FIG. 3) is housed within the interior space 90 of the cylindrical cover 30 and has a key slot 110 in a front face 120 thereof. A barrel 130 is rotatably captured within a cylinder 140, such that the barrel 130 is only rotatable within the cylinder 140 when a properly-shaped key 150 is inserted into the key slot 110. The barrel 130 includes a cam follower 160 that rotates between a locked position 170 and an unlocked position 180. Preferably the cylinder 140 includes a cylinder foot 220 for non-rotationally engaging the cylindrical cover 100, which is adapted to be cooperative therewith (FIG. 6).

A bolt assembly 190 is fixed at a proximal end 200 to the cam follower 160 and adapted so that a bolt 210 thereof at least partially traverses the staple slot 80 when the cam follower 160 is moved from the unlocked position 180 to the locked position 170. The bolt 210 is preferably formed from hardened steel, or other suitably strong material.

As such, in use, with the lock 10 engaged over the staple 20 and a hasp 25 (FIG. 1), for example, the key 150 is inserted into the key slot 110 and the barrel 130 is turned such that the bolt 210 traverses the staple slot 80 to fix the staple 20 thereto.

Figure 4:
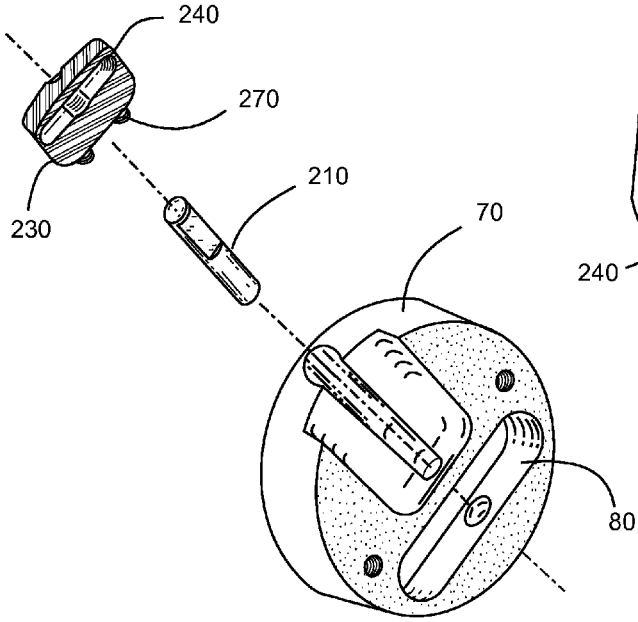
FIG. 4 is an exploded view of a slider block of the invention.
Figure 5:
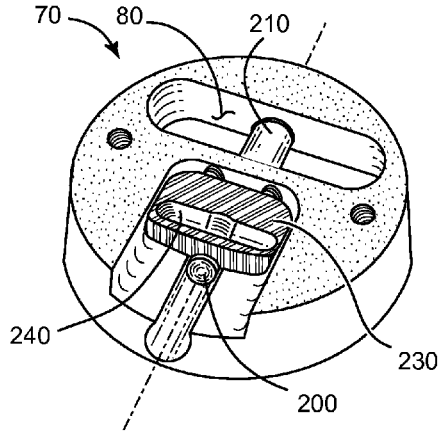
FIG. 5 is an enlarged perspective view of the slider block as engaged with a rear side of a cylindrical cover of the invention.
Figure 10:
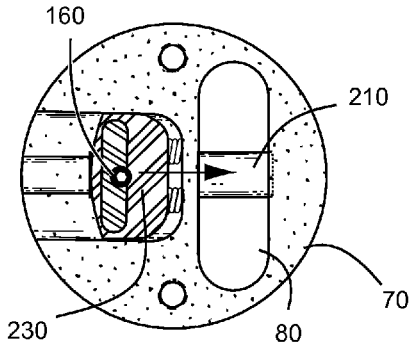
FIG. 10 is an elevation view of the slider block and bolt in the locked position, and further illustrating a cam follower location for the locked position.
Figure 11:
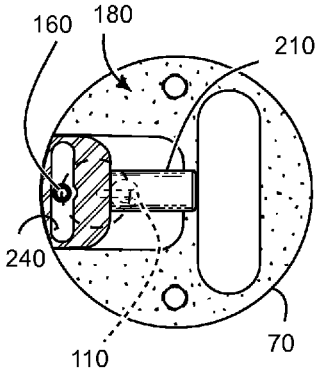
FIGS. 11, 12, and 13 are progressive diagrammatic elevation views of the slider block and cam-follower as the cam-follower and key slot, in phantom outline, rotate from unlocked, to partially locked, to fully locked positions, illustrating a key rotation circle which is the locus of points the cam-follower travels as the key is rotated.
Figure 12:
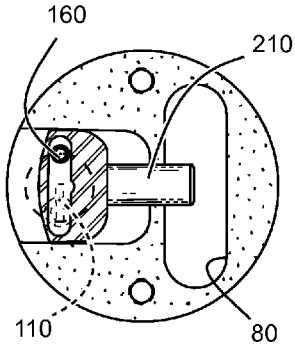
Figure 13:
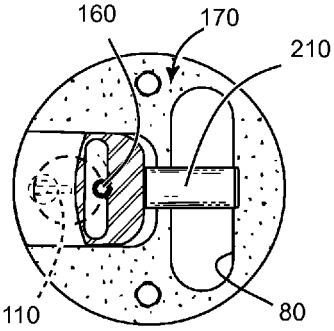
Figure 14:
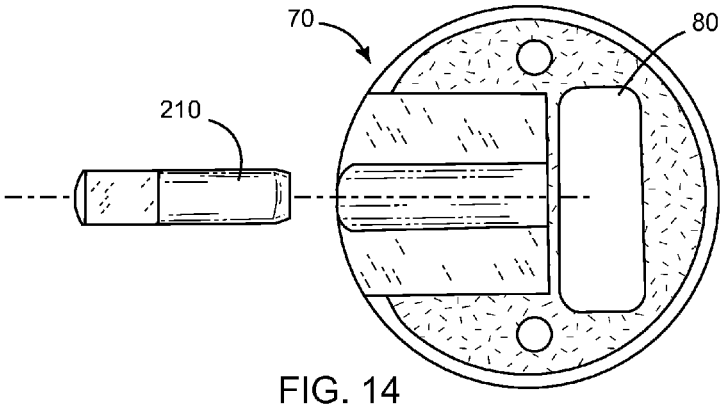
FIG. 14 is an elevation view of a bolt and base of a second preferred embodiment of the invention.
Figure 16:
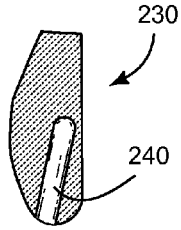
FIG. 16 is an elevation view of an alternate slider block of the invention.
Figure 15:
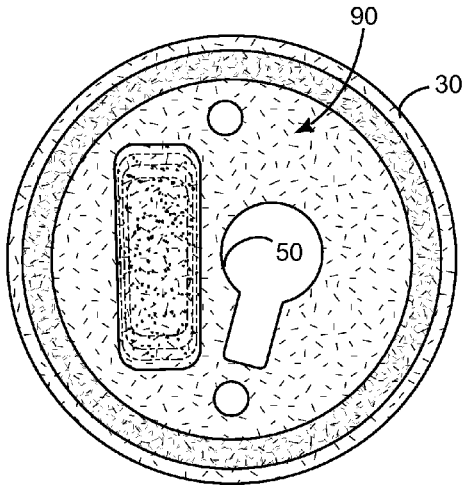
FIG. 15 is a rear elevation view of a cylindrical cover, illustrating an open rear side exposing an interior space therein.
Figure 17:
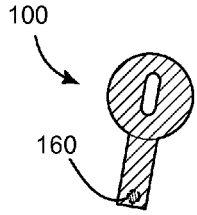
FIG. 17 is cross-sectional elevation view of a cylinder from the key-slot end showing the location of a cam-follower fixed to the other end thereof.
Figure 18:
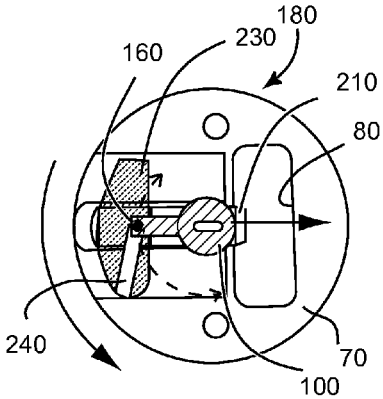
FIGS. 18, 19, and 20 are progressive diagrammatic elevation views of the second preferred embodiment of the invention as the cam-follower and cylinder rotate from unlocked, to partially locked, to fully locked positions, illustrating a cam-follower rotation path which is the locus of points the cam-follower travels as the key is rotated.
Figure 19:
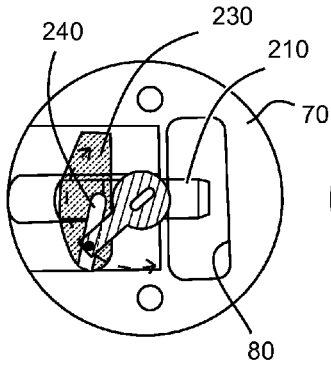
Figure 20:
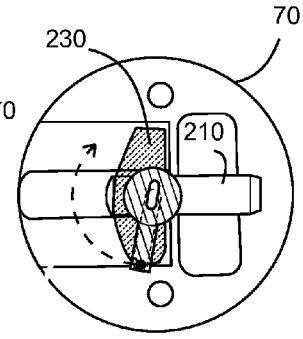
Figure 21:
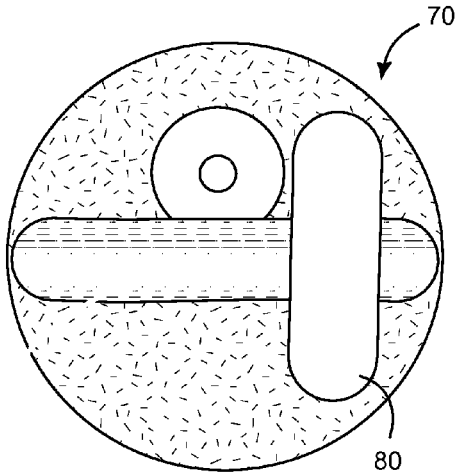
FIG. 21 is an elevation view of a base of a third embodiment of the invention.
Figure 22:
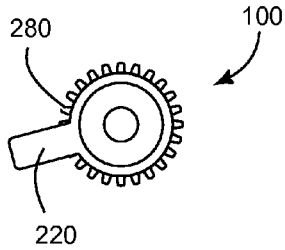
FIG. 22 is an elevation view of a cylinder incorporating a pinion gear.
Figure 23:
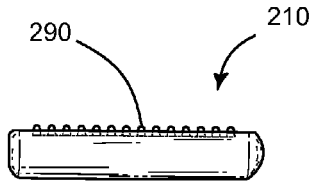
FIG. 23 is an elevation view of a bolt incorporating a rack.
Figure 24:
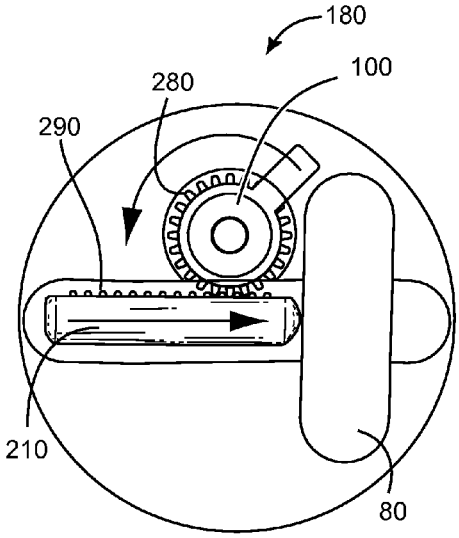
FIG. 24 is a diagrammatical elevation view of the third embodiment of the invention, illustrating the rack and pinion gears engaged such that cylinder rotation causes axial bolt translation, illustrated in an unlocked position.

In one embodiment of the invention, illustrated in FIGS. 1-14, the bolt assembly 190 includes a slider block 230 that has a cam slot 240 for receiving the cam follower 160 of the barrel 130. The bolt 210 in such an embodiment is fixed to the slider block 230 such that in the unlocked position 180 of the cam follower 160 the bolt 210 is substantially retracted from the staple slot (FIG. 11). With the cam follower 160 in the locked position 170, the bolt 210 traverses the staple slot 80 (FIGS. 5, 10 and 13). Further, the slider block 230 may include a detent means 250 (FIGS. 9-13), such as a notch 260 in the cam slot 240 proximal to the bolt 210 and a spring means 270, such as coil springs or the like, for biasing the slider block 230 towards the cam follower 160. As such, as the cylinder 140 rotates within the barrel 130, tactile feedback is provided through the key 150 that the cam follower 160 has achieved the locked position 170. Preferably the cam slot 240 is perpendicular to the longitudinal axis of the bolt 210 (FIGS. 4 and 5). Alternately, the cam slot 240 may be angled with respect to the longitudinal axis of the bolt 210 (FIGS. 15-20).

Figure 25:
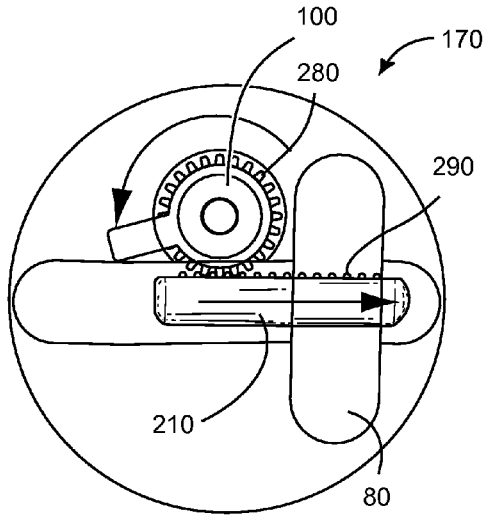
FIG. 25 is a diagrammatical elevation view of the third embodiment of the invention, illustrated in a locked position.
Figure 26:
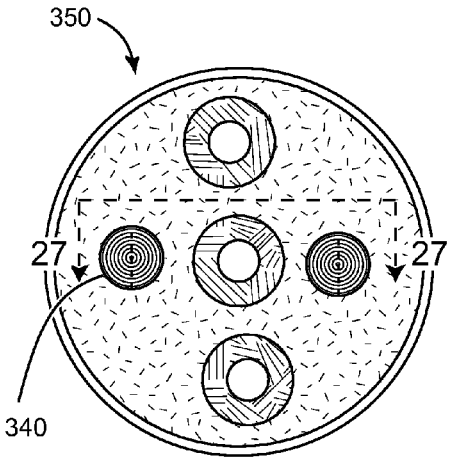
FIG. 26 is an elevation view of a base with two protruding pointed prongs of a fourth embodiment of the invention.
Figure 27:
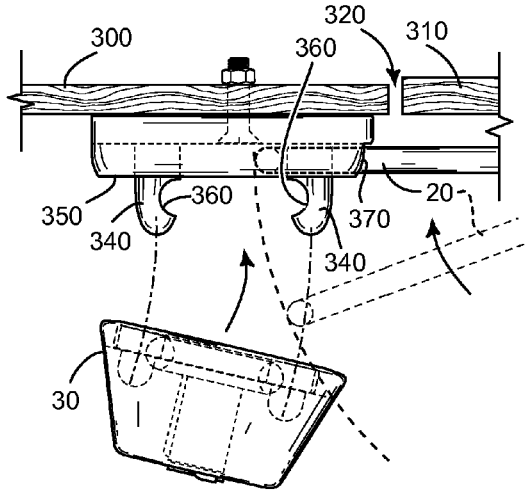
FIG. 27 is an elevation sectioned view of the base, the section taken generally along lines 27-27 of FIG. 26, and further illustrating cylindrical grooves formed into prongs for accepting a toroidal or partially circular bolt of the invention.
Figure 28:
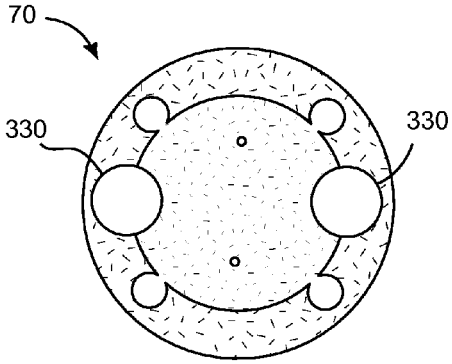
FIG. 28 is an elevation view of a spacer of the invention, fixed within the interior space of the cylindrical cover.
Figure 29:
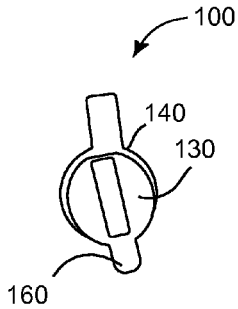
FIG. 29 is an elevation view of a cylinder with the cam follower for rotating the toroidal bolt.

In another embodiment of the invention, illustrated in FIGS. 21-25, the barrel 130 includes an outer pinion gear 280 and the bolt assembly includes a rack gear 290 cooperative therewith. As such, rotating the barrel 130 causes the outer pinion gear 280 to engage the rack gear 290 of the bolt 210 to slide the bolt 210 longitudinally to traverse the staple slot 80 (FIG. 25).

Figure 30:
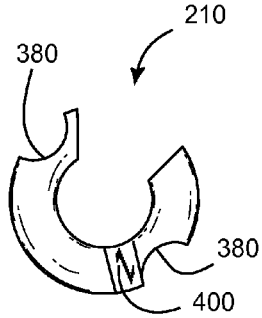
FIG. 30 is an elevation view of the toroidal bolt, illustrating a flat cam follower groove for receiving the cam follower and further illustrating two cylindrical grooves alignable with the prongs for unlocking the prongs and hence the lock.
Figure 31:
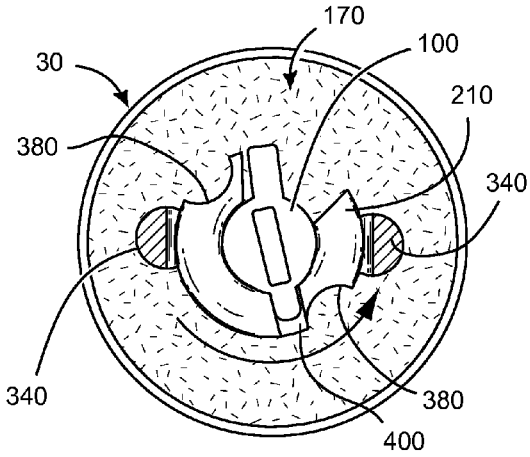
FIG. 31 is an elevation diagrammatical view of the fourth preferred embodiment of the invention illustrated in the closed position.
Figure 32:
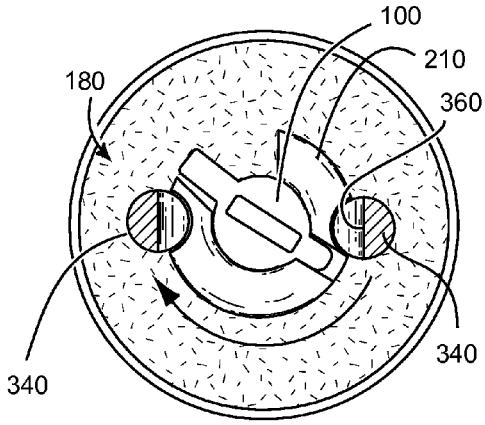
FIG. 32 is an elevation diagrammatical view of the fourth preferred embodiment of the invention illustrated in the opened position.

In an alternate embodiment of the invention, illustrated in FIGS. 26-32, the staple 20 is of the type fixed to one part 300 of a closure 320 (FIG. 27), and the staple slot 80 includes a pair of prong apertures 330 for receiving a pair of prongs 340 projecting outwardly from a prong plate 350 fixed to another part 310 of the closure 320. The staple 20 is adapted to fit around one of the prongs 340, each of which has an inward-facing notch 360. The prong plate 350 has a staple slot 370 in the side wall thereof for receiving the staple 20. The bolt 210, in such an embodiment, is partially circular and includes a pair of prong grooves 380 on an outer surface 390 (FIG. 30). The bolt 210 further includes a cam follower groove 400 for receiving the cam follower 160 of the lock cylinder assembly 100, such that with the two parts 300,310 of the closure 320 brought into mutual proximity and with the staple 20 engaged around one of the prongs 340 of the prong plate 350, the cover 30 may be fit over the prongs 340, the prong grooves 380 aligned with the prong apertures 330 to receive each prong 340 fully therein. To lock the lock 10 of such an embodiment, the barrel 130 is then rotated by the key 150 to rotate the bolt 210 such that the prong grooves 380 become misaligned with the prong apertures 330, whereby the bolt 210 captures each prong 340 at its prong notch 360, thereby preventing removal of the cover 30 from the prong plate 350 and the subsequent removal of the staple 20 from the lock. A spacer (FIG. 28) may further be included to receive each prong 340 at the proper depth within the cylindrical cover 30.

While a particular form of the invention has been illustrated and described, it will be apparent that various modifications can be made without departing from the spirit and scope of the invention. For example, various lock barrels 130 and cylinders 140, each that work with various types of keys 150, may be used in the present lock 10. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A lock for engaging a staple, comprising:

a cylindrical cover having a front face open at a key hole aperture, a continuous side wall, and a rear side open at least at a staple slot, the cylindrical cover defining an interior space therein;

a lock cylinder assembly housed within the interior space of the cylindrical cover and having a key slot in a front face thereof, a barrel rotatably captured within a cylinder, the barrel rotatable within the cylinder only when a properly-shaped key is inserted into the key slot, the barrel including a cam follower that rotates between a locked position and an unlocked position;

a bolt assembly fixed at a proximal end to the cam follower and adapted so that a bolt thereof at least partially traverses the staple slot when the cam follower is moved from the unlocked to the locked position thereof, the bolt assembly sliding in a longitudinal track with the bolt;

whereby with the lock engaged over the staple, the key can be inserted into the key slot and the barrel turned such that the bolt traverses the staple slot to fix the staple thereto, the bolt assembly including a slider block having a cam slot for receiving the cam follower of the barrel, the bolt fixed to the slider block such that in the unlocked position of the cam follower the bolt is substantially retracted from the staple slot and, with the cam follower in the locked position, the bolt traverses the staple slot, the slider block including a detent means for tactile feedback of the cam follower achieving the locked position, the detent means including a notch in the cam slot proximal to the bolt and a spring means biasing the slider block towards the cam follower.

2. A lock for engaging a staple, comprising:

a cylindrical cover having a front face open at a key hole aperture, a continuous side wall, and a rear side open at least at a staple slot, the cylindrical cover defining an interior space therein;

a lock cylinder assembly housed within the interior space of the cylindrical cover and having a key slot in a front face thereof, a barrel rotatably captured within a cylinder, the barrel rotatable within the cylinder only when a properly-shaped key is inserted into the key slot, the barrel including a cam follower that rotates between a locked position and an unlocked position;

a bolt assembly fixed at a proximal end to the cam follower and adapted so that a bolt thereof at least partially traverses the staple slot when the cam follower is moved from the unlocked to the locked position thereof, the bolt assembly sliding in a longitudinal track with the bolt;

whereby with the lock engaged over the staple, the key can be inserted into the key slot and the barrel turned such that the bolt traverses the staple slot to fix the staple thereto, the barrel including an outer pinion gear, and the bolt assembly including a rack gear cooperative therewith, such that rotating the barrel causes the outer pinion gear to engage the rack gear of the bolt assembly to slide the bolt longitudinally to traverse the staple slot.

3. A lock for engaging a staple, comprising:

a cylindrical cover having a front face open at a key hole aperture, a continuous side wall having a staple slot therein for receiving a staple from one part of a closure, and a rear side including a pair of prong apertures for receiving a pair of prongs projecting outwardly from a prong plate fixed to another part of the closure, the staple adapted to fit around one of the prongs, each prong having an inward-facing notch, the cylindrical cover defining an interior space therein;

a lock cylinder assembly housed within the interior space of the cylindrical cover and having a key slot in a front face thereof, a barrel rotatably captured within a cylinder, the barrel rotatable within the cylinder only when a properly-shaped key is inserted into the key slot, the barrel including a cam follower that rotates between a locked position and an unlocked position;

the bolt being partially circular and including a pair of prong grooves on an outer surface thereof, the bolt further including a cam follower groove for receiving the cam follower of the lock cylinder assembly;

whereby with the two parts of the closure brought into mutual proximity such that the staple may be engaged around one of the prongs of the prong plate, the cover may be fit over the prongs with the prong grooves aligned with the prong apertures to receive each prong fully therein, the barrel then can be rotated by the key to rotate the bolt such that the prong grooves become misaligned with the prong apertures, thereby capturing the prongs at their prong notches and preventing removal of the cover from the prong plate and the subsequent removal of the staple from the lock.

* * * * *